United States Patent [19]

de Rougemont

[11] 4,262,616

[45] Apr. 21, 1981

[54] SAILING-BOAT MAST

[75] Inventor: Christian de Rougemont, Paris, France

[73] Assignee: Isomat, France

[21] Appl. No.: 972,727

[22] Filed: Dec. 26, 1978

[30] Foreign Application Priority Data

Dec. 30, 1977 [FR] France ..... 77 39762

[51] Int. Cl.[3] ..... B63B 15/00

[52] U.S. Cl. ..... 114/94; 114/99

[58] Field of Search ..... 114/94, 89, 90, 97, 114/99, 102, 108, 39, 98

[56] References Cited

U.S. PATENT DOCUMENTS

| | | | |
|---|---|---|---|
| 2,673,543 | 3/1954 | Plym | 114/98 |
| 3,343,514 | 9/1967 | Brett | 114/108 |
| 3,678,876 | 7/1972 | Alter | 114/102 |
| 3,866,558 | 2/1975 | Bergstrom et al. | 114/90 |

FOREIGN PATENT DOCUMENTS

| | | | |
|---|---|---|---|
| 1217025 | 12/1970 | United Kingdom | 114/94 |
| 1218455 | 1/1971 | United Kingdom | 114/102 |

*Primary Examiner*—Sherman D. Basinger

*Attorney, Agent, or Firm*—Garrettson Ellis; George H. Gerstman

[57] ABSTRACT

A mast of simplified and standardized constructional design consists of a tubular section and ancillary components such as a masthead or boom support plates which are welded to the tubular section, the masthead being constituted by a casing and head-piece. The casing is provided with an incorporated anchoring member for the standing rigging, and with slots for receiving the axle-pins of sheaves and rollers. The casign head-piece has a central cheek for locking the sheave pins in position.

3 Claims, 3 Drawing Figures

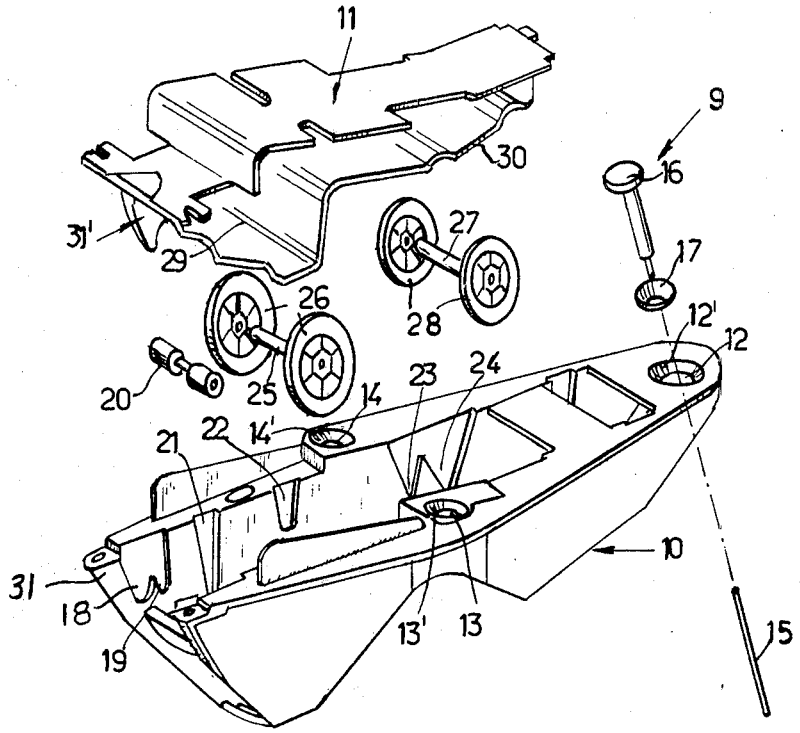
FIG. 2
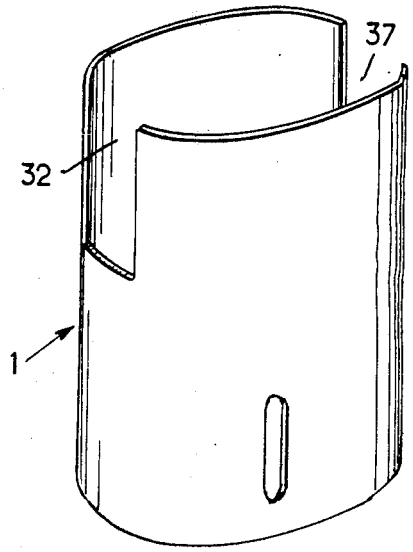

SAILING-BOAT MAST

This invention relates to a sailing-boat mast.

It is known that sailing-boat masts comprise a large number of ancillary components such as a masthead, anchoring means for standing rigging, support plates for gaff sail booms, spinnaker boom rails and grooves for slide-blocks or stay ropes. Up to the present time, the majority of these ancillary components have been mounted separately on a tubular section which forms the mast and have been attached by riveting. It has thus proved necessary to carry out a large number of machining and assembly operations entailing high capital outlay. Furthermore, the method of attachment by means of rivets gives rise to corrosion problems.

The general aim of this invention is to overcome the disadvantages mentioned above, to reduce production costs and to permit standardization of the different elements.

The present invention is directed to a sailing-boat mast constituted by a tubular section and ancillary components, especially a masthead and support plates for gaff sail booms, said ancillary components being welded to said section, and comprising anchoring means which form an integral part of said components for the standing rigging.

Attachment of the ancillary components by welding as well as incorporation of the anchoring means result in a considerable reduction of corrosion hazards.

In the mast according to the invention, the means for anchoring the different components are each advantageously constituted by a duct having a flared-out and rounded inlet orifice in which is mounted a knuckle-joint assembly for the end portion of standing rigging, said end portion being provided with a terminal enlargement which corresponds in shape to said flared-out portion.

The knuckle-joint assembly makes it possible to dispense with the universal joints which are employed especially on preventer stay and shroud connectors, thereby achieving a reduction in cost price and permitting the possibility of standardization of all standing rigging terminations.

The masthead in accordance with the invention is constituted by a casing which is welded to the section and by a removable head-piece. Said casing is provided with means for anchoring standing rigging, with slots for receiving the supporting shafts or pins of sheaves and horizontal rollers and with lateral guiding means for running rigging. Said head-piece serves to lock the sheave pins in position, forms partition-walls and is provided with lateral guiding means for the spinnaker halyard.

The masthead is fabricated in the foundry and the slots permit of rapid assembly of the sheaves on a headless shaft in which no provision is made for any drilled hole, thus achieving an appreciable reduction in labor costs. The masthead can be employed either as an inner or an outer halyard by means of horizontal rollers which permit easy swaying-up of the spinnaker halyard; the lateral guiding means for said halyard are preferably constituted by friction members which are cast in one piece with the casing mentioned above.

The masthead in accordance with the invention makes it possible to dispense with spinnaker halyard blocks and brackets, thereby achieving a reduction in top-hamper rigging and in cost price. The structure consisting of two parts, namely a casing and a removable head-piece, permits of rapid assembly and disassembly, ease of access for mounting and replacing halyards, lights and other electrical appliances, thus saving time and facilitating operations. The head-piece performs a double function in that it serves to provide partition-walls and to lock the sheave pins in position, thus making it possible to pass all the halyards through a single messenger and to achieve a further saving in time of assembly.

In accordance with a preferred embodiment, the masthead casing is provided with a plurality of slots for each sheave pin and for each roller. This permits standardization of the masthead which can thus be mounted on sections having different sizes, the mainsail and boom topping-lift sheaves, for example, being mounted in the appropriate slots as a function of the size of the mast.

In order to reduce construction costs, the maximum number of ancillary mast components are extruded in one piece with the section, especially the spinnaker boom rail which is so shaped as to produce turbulences for ensuring early re-application of airstream filaments against the mainsail intrados and thus improving propulsion of the sailing boat, and a groove for a slide-block which is adaptable to a stay rope.

The section is advantageously provided on its internal wall with at least one rib which is also extruded in one piece with the section and is employed on the one hand for the attachment of electric cable sheaths or the like.

The gaff sail boom support plates are also fabricated in the foundry and are welded to the section. Sections of different sizes advantageously have the same radius of curvature in the zone of attachment of the gaff sail boom support plates which can thus be manufactured in large-scale production for different sections.

A more complete understanding of the invention will be gained from the following detailed description and from the accompanying drawings in which one embodiment of the invention is shown by way of example without any limitation being implied, and in which:

FIG. 2 is an exploded view of a masthead and of the top portion of a mast section in accordance with the invention;

Figure 1:
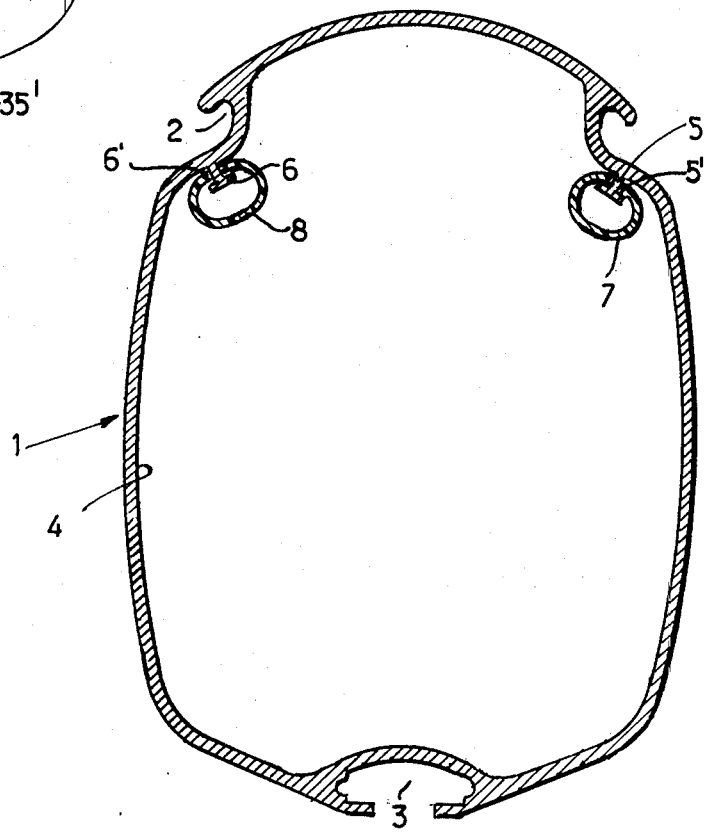
FIG. 1 is a transverse sectional view of a mast section in accordance with the invention.

The mast section 1 in accordance with the invention and shown in FIG. 1 is entirely produced in a foundry without any part being added thereto. The section 1 comprises a spinnaker boom rail 2 and a groove 3 which permits the use of slide-blocks and/or which is capable of accommodating a plastic sectional member for a staysail. On its internal wall 4, the section 1 is provided with two T-shaped strengthening ribs 5 and 6. The ribs 5 and 6 also serve to attach electric cable sheaths 7, 8. The sheaths 7 and 8 are slidably mounted on the ribs 5 and 6 by means of a longitudinal slot 5', 6' whilst the cross-bar of the T of each rib is introduced into the interior of each cable sheath, thus anchoring said sheaths in position.

In FIG. 2, the masthead is generally designated by the reference numeral 9. The head 9 comprises a casing 10 and a removable head-piece 11; the casing 10 is provided with incorporated anchoring means 12 for a preventer shroud, 13 and 14 for back-stays, and also with anchoring means for fore-stays (not shown in FIG. 2). The anchoring means 12, 13, 14 are each constituted by a duct, the inlet of which consists of a flared-out and rounded portion 12', 13' and 14' for a knuckle-joint assembly. As shown in the figure, this assembly is of conical design for the preventer shroud 15, the end of which is provided with a head 16 having a terminal enlargement which is complementary in shape to the flared-out portion 12'. A dished washer 17 is mounted between the head 16 and the portion 12'. The casing 10 is provided with slots 18, 19 for receiving rollers 20 which are mounted in either of the two slots 18, 19 according to the size of the section 1. Similarly, the casing 10 is provided with slots 21, 22 for an axle-pin 25 which carries sheaves 26, and with slots 23, 24 for an axle-pin 27 which carries sheaves 28. The head-piece 11 has a central cheek 29 which forms a partition-wall and the bottom edge 30 of which has a suitable shape for locking the sheave pins within the slots. The masthead 9 can be employed as an inner or outer halyard by means of the horizontal rollers 20 which permit easy swaying-up of the spinnaker halyard (not shown), the means for lateral guiding of this latter being constituted by a friction member 31 on the casing 10 and a friction member 31' on the central cheek 29, said members being cast in one piece with the casing 10 and the head-piece 11. The head-piece 11 is mounted by screws on the casing 10 which is in turn welded to the section 1 and partially engaged in this latter by means of openings 32, 37 at the upper end of said section 1.

Figure 3:
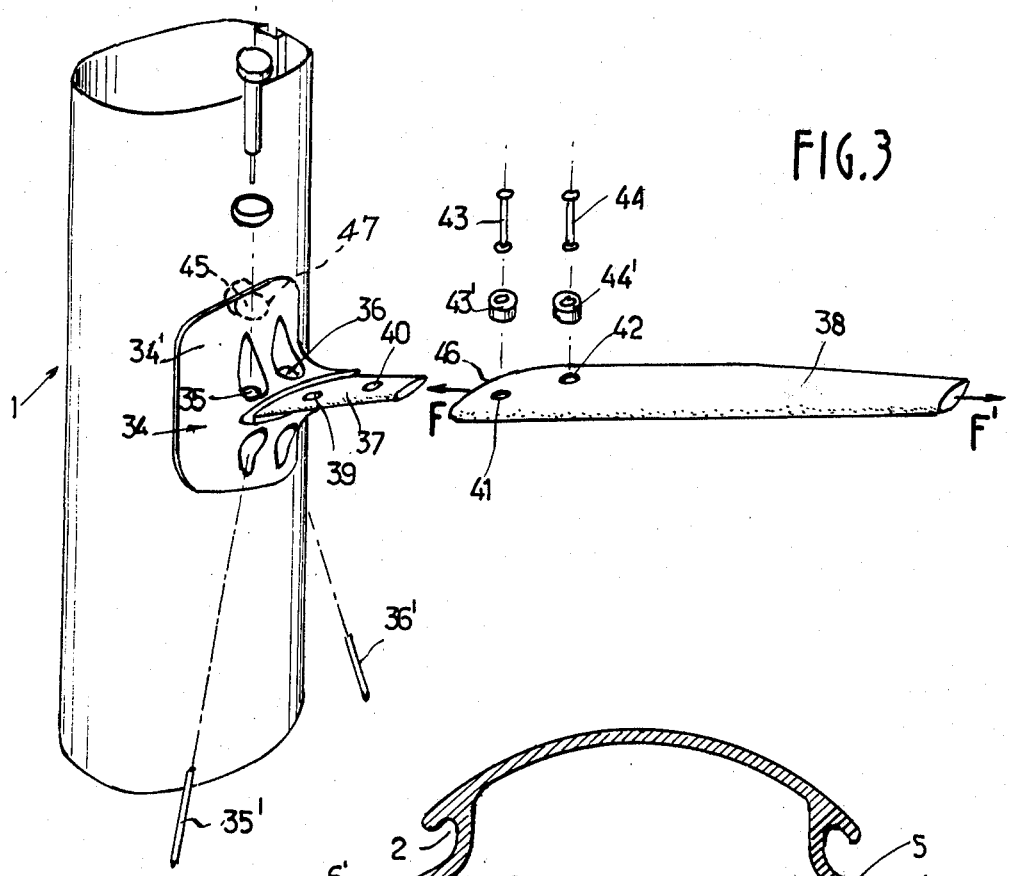
FIG. 3 shows a gaff sail boom support plate on a mast in accordance with the invention.

A gaff sail boom support plate 34 (shown in FIG. 3) comprises a sole-piece 34' which is welded to the section 1 and anchoring means 35, 36 respectively for a lower fore-stay 35' and a lower back-stay 36'. The anchoring means 35, 36 which are cast in one piece with the support plate 34 are constructed in the same manner as the anchoring means 12 to 14 of the masthead 9. The support plate 34 further comprises an assembly element 37 which is adapted to engage in a gaff sail boom 38. The assembly element 37 is provided with two drilled holes 39 and 40 which are located in exact correspondence with drilled holes 41 and 42 of the gaff sail boom for the insertion of fastening components 43, 44 such as bolts and nuts with interposition of rubber cushions 43', 44' of the "silent-block" type. The assembly and engagement element 37 ensures good and rapid positioning of the gaff sail boom 38.

At least one stud 45 cast in one piece with the sole-piece 34' engages within a corresponding drilled hole 47 of the section 1, facilitates positioning of the support plate 34 and absorbs the tensile stresses exerted on the lower stays 35' and 36'.

It will likewise be noted that the assembly element 37 decreases in size towards its free end. The gaff sail boom 38 can thus be set at the desired angle with respect to the section 1 by suitably choosing the angle made by the front portion 46 of the gaff sail boom 38 with the axis F-F' of said gaff sail boom 38.

We claim:

1. A sailing boat mast comprising a tubular section and an ancillary component comprising a masthead which is welded to said section, said masthead comprising anchoring means, forming an integral part thereof, for the standing rigging, said anchoring means comprising a duct defining a flared-out and rounded inlet orifice in which is mounted a knuckle-joint assembly for retaining the end portion of standing rigging, said end portion being provided with a terminal enlargement which corresponds in shape to said flared-out portion, said masthead also comprising a casing welded to the tubular section and a removable head-piece, said casing being provided with means for anchoring standing rigging, and slots receiving supporting axle-pins of sheaves and horizontal rollers, said head-piece defining a cheek on the bottom edge of said head-piece for holding the sheave pins in their slots, and with lateral guiding means for running rigging, said head-piece being adapted to lock the sheave pins in position and defining partition-wall means, said lateral guiding means being adapted to receive a spinnaker halyard and comprising friction members cast in one piece with said casing and head-piece, said masthead casing being provided with a plurality of slots to receive each sheave pin and each roller, whereby the sheave pins and rollers can be positioned within the casing as a function of size of the mast on which said casing is mounted and as a function of inner and outer utilization of the halyards.

2. A mast according to claim 1 which includes gaff sail boom support plate means provided with a positioning stud and anchoring means for at least one stay, and an assembly element which is capable of engaging within a gaff sail boom, said assembly element being provided with at least one drilled hole for the insertion of fixing elements.

3. The sailing boat mast of claim 1 in which first friction member means is carried on said cheek and second friction member means is carried on said casing, for guiding the spinnaker halyard.

* * * * *